US005472025A

United States Patent [19]

Conrad et al.

[11] Patent Number: 5,472,025

[45] Date of Patent: Dec. 5, 1995

[54] UNIVERSAL FUNNEL ADAPTOR

[76] Inventors: Randy Conrad; Karin M. conrad, both of 2110 E. Carleton Rd., Adrian, Mich. 49221

[21] Appl. No.: 343,333

[22] Filed: Nov. 21, 1994

[51] Int. Cl.[6] ..... B65B 39/00; B65C 11/04

[52] U.S. Cl. ..... 141/332; 141/331; 141/346; 141/383; 141/384; 141/340; 285/377

[58] Field of Search ..... 141/383, 384, 141/319, 332, 346, 331, 340, 363, 364, 375; 285/177, 377, 393; 403/342

[56] References Cited

U.S. PATENT DOCUMENTS

| | | | |
|---|---|---|---|
| 333,336 | 2/1893 | Rigel | D23/200 |
| 334,514 | 4/1893 | Fidler | D7/700 |
| 2,556,627 | 2/1950 | Miksis | 222/568 |
| 2,680,896 | 8/1952 | Cupit | 285/177 |
| 3,537,623 | 11/1970 | Fisher | 222/4 |
| 4,951,721 | 8/1990 | Moore et al. | 141/90 |
| 5,020,702 | 6/1991 | James | 22/529 |
| 5,195,567 | 3/1993 | Tyree, Jr. | 141/331 |
| 5,259,426 | 11/1993 | Burleigh et al. | 141/98 |

*Primary Examiner*—Henry A. Recla
*Assistant Examiner*—Timothy L. Maust
*Attorney, Agent, or Firm*—Henry S. Miller; Rhodes & Ascolillo

[57] ABSTRACT

An adaptor for stabilizing a funnel in the opening of a container consists of a body of metal or plastic which contains a central bore internally threaded at each end for accepting the threaded stem of a funnel. The body is externally threaded on one end to engage internally threaded container openings and at the other end contains an internally threaded cavity to engage externally threaded container openings.

4 Claims, 3 Drawing Sheets

UNIVERSAL FUNNEL ADAPTOR

BACKGROUND OF THE INVENTION

1. Field of the Invention

The invention relates generally to adaptors and more particularly to adaptors for joining funnels to barrels cans and bottles.

2. Description of the Prior Art

One of the better kept secrets in the mechanical arts is that the common funnel requires two hands to operate. That is fine, of course, if the product being dispensed is capable of being carried in one hand, since the other hand is used to keep the funnel from tipping. If the aperture on the container being filled were large enough, the sides of the funnel would rest on the ring of the aperture. If this were so, there would be little need for a funnel. In the practical situation, the average user has an open top container or pail that holds five or six quarts of hot motor oil or anti freeze and is attempting to be environmentally prudent and pour the contents into a 55 gallon drum or other small mouthed container. Experience shows that using a funnel in this situation requires at least three hands, two for the container and one to hold the funnel upright. The commonly used alternative is to attempt to maneuver the funnel with the edge of the container as the fluid is poured, this approach has been found to lack merit and usually ends up spilling more fluid than finally ends up in the container.

Funnels aimed at avoiding the problem of spillage include, U.S. Pat. No. 3,537,623 issued Nov. 3, 1970 to Fisher and discloses a funnel that accepts a container and seals it in such a manner that it is nearly impossible for fluid to accidently escape. U.S. Pat. No. 4,951,721 issued Aug. 28, 1990 to Moore et al. discloses an oil drain funnel with a means to release and capture a drain plug in the funnel. A U.S. Design Patent was issued on Feb. 16, 1993 to Rigel, No. Des. 333,336 for a funnel for oil but it is unclear how this invention constitutes a funnel. It appears however that there are external threads on one end and a valve in the lower end of the tube near the threads. Another U.S. Design Pat. No. 334,514 was issued on Apr. 6, 1993 to Fidler for an attachable funnel. The stem of the funnel includes an apparatus which will apparently attach to something in some unknown and unexplained fashion. An oil drain funnel is shown in U.S. Pat. No. 5,259,426 issued Nov. 9, 1993 to Burleigh et al. which, in principle, resembles the above mentioned patent to Moore et al. utilizing a support for a socket wrench which will remove the drain plug when the funnel is placed against the plug and turned.

The prior art fails to show an adapter for a funnel that will allow the funnel to be attached to vessels and containers having different size apertures.

SUMMARY OF THE INVENTION

The invention is directed to a universal adaptor for a funnel that will attach the funnel to a container whereby the funnel will remain in an upright position while leaving the user with both hands free to pour the contents of one container into another container. The adaptor is generally cylindrical in shape and contains a central bore which is internally threaded at each end. The bore threads correspond to the external threads of a funnel stem designed for the purpose. One end of the adapter is threaded externally to engage internally threaded apertures such as those found on 55 gallon barrels. The opposing end of the adaptor is internally threaded to engage externally threaded containers such as the common 5 gallon oil or gas can.

It is therefore an object of the invention to provide a new and improved funnel adaptor.

It is another object of the invention to provide a new and improved funnel adaptor that is convenient and simple to use.

It is a further object of the invention to provide a new and improved funnel adaptor that has all the advantages of similar prior art like devices but none of the disadvantages.

It is still another object of the invention to provide a new and improved funnel adaptor that may be easily and efficiently manufactured and marketed.

It is still a further object of the invention to provide a new and improved funnel adaptor which is of a durable and reliable construction.

It is another object of the invention to provide a new and improved funnel adaptor which may be manufactured for a low cost and accordingly sold at a low price.

These together with other objects of the invention along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
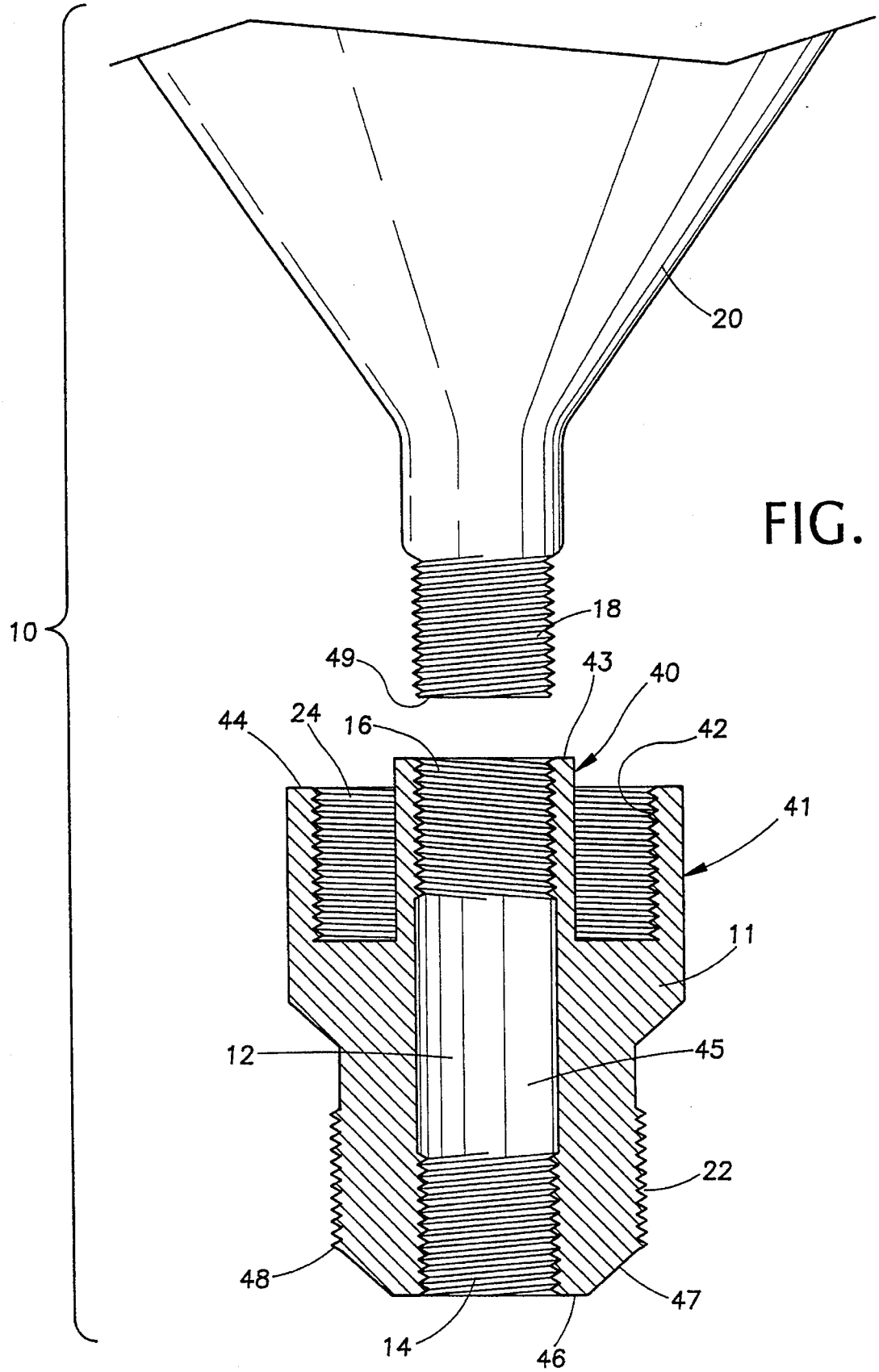
FIG. 1 is a cross sectional view of the invention.

Referring now to FIG. 1, the invention is a cylindrically shaped body of metal or plastic shown generally at 10, and contains a central bore 12 having internal threads 14 and 16 at each end which are compatible with the threaded stem 18 of funnel 20. The body of the adaptor 11 contains external threads 22 at one end for engaging the threads of an internally threaded container aperture such as those found on the common fifty-five gallon drum used to store and transport petroleum and chemical products. The opposed end of the adaptor contains an internally threaded portion concentric with the internally threaded portion 16 whereby the adaptor is capable of engaging the external threads of a container having such threads. An illustrative example of such container is a standard 5 gallon gas can. A universal funnel adaptor 10 has a cylindrically shaped body or adaptor 11. The cylindrically shaped body 11 has a central bore 12 extending through the body. There is an inner wall 40 and an outer wall 41 of the body. There are outer wall threads or adaptor internal threads 24 on a inner surface 42 of the outer wall 41. An upper end 43 of the inner wall 40 extends above an upper surface 44 of the outer wall 41. There are upper internal threads or adaptor threads 16 in a perimeter 45 of the central bore 12.

There are lower internal threads or adaptor threads 14 in the perimeter 45 of the central bore 12. There are external threads 22 proximate an end 46 of the body 11 distal the upper surface 44 of the outer wall 41. There is a surface 26 for handling and munipulating the body. A chamfered insertion end 47 is on an outer edge 48 of the outer end 46 of the body distal the upper surface 44 of the outer wall 41.

There is a funnel 20 having engagement threads or funel threads 18 on one end 49. The engagement threads 18 selectively, threadingly and releasably engage the upper internal threads 16 or the lower internal threads 14 of the central bore.

Figure 2:
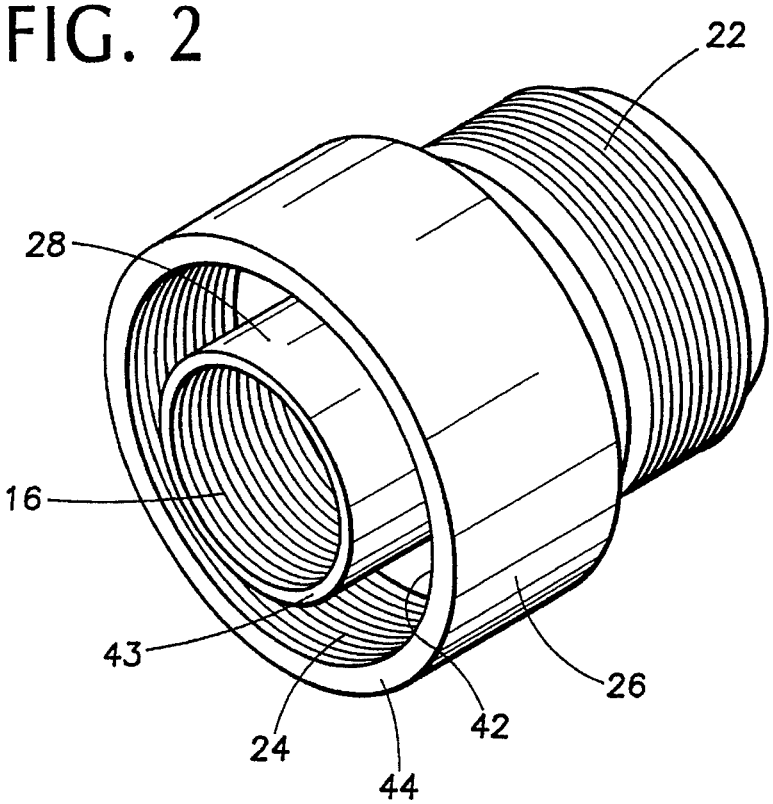
FIG. 2 is a perspective view of the invention showing the internally threaded coupling portion.
Figure 3:
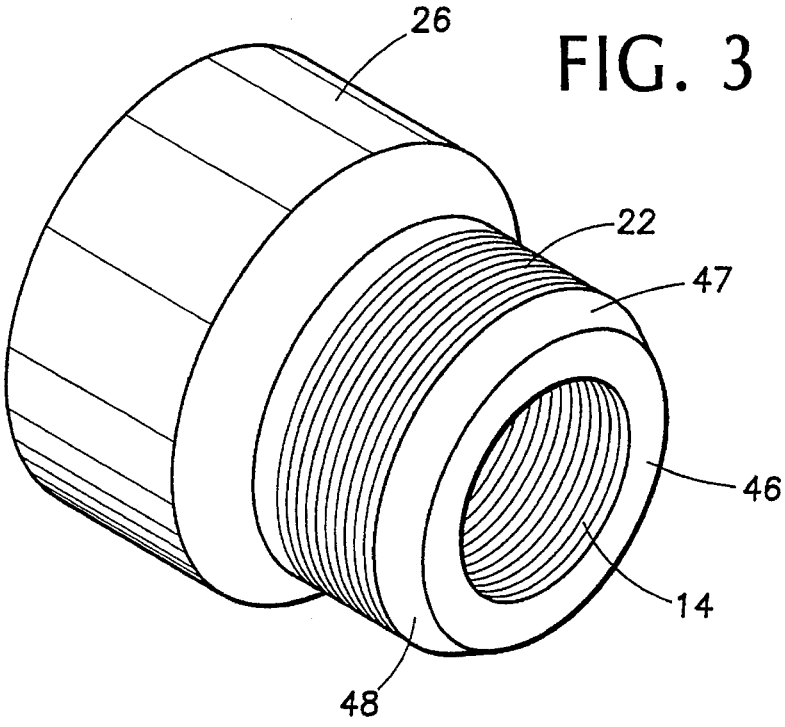
FIG. 3 is a perspective view of the invention showing the externally threaded coupling portion.

Concerning FIGS. 2 and 3, the adaptor includes a cylindrically shaped portion 26 that is particularly suited for handling the adaptor either by hand or the application of a standard pipe wrench. The funnel adapter portion 28 of the invention extends from the body for convenience in attaching and engaging the funnel threads. The threads of the adaptor are standard pipe threads and thereby allow the adaptor to function in a variety of situations using standard plumbing parts, as for example it would be within the scope of the invention to connect a funnel extension between the funnel threads 18 and the adaptor threads 14 or 16, likewise the invention is seen to encompass an extension to the outlet end of the adaptor in the case where the container might be compartmentalized and particular fluids are to be stored in selected areas.

Figure 5:
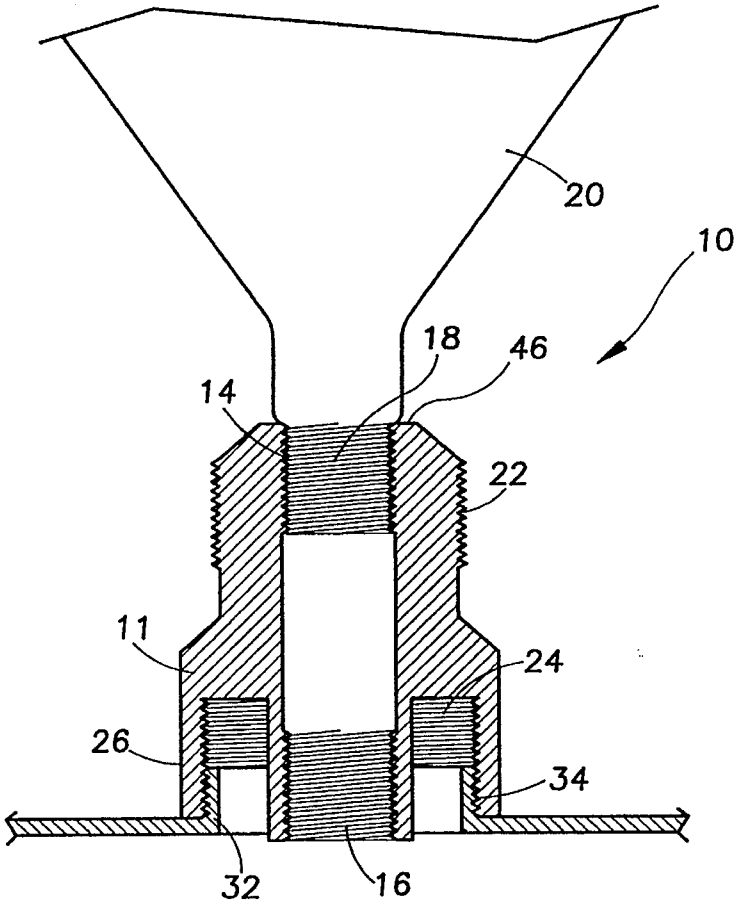
FIG. 5 is a cross sectional view of the invention assembled between a funnel and an externally threaded opening.
Figure 4:
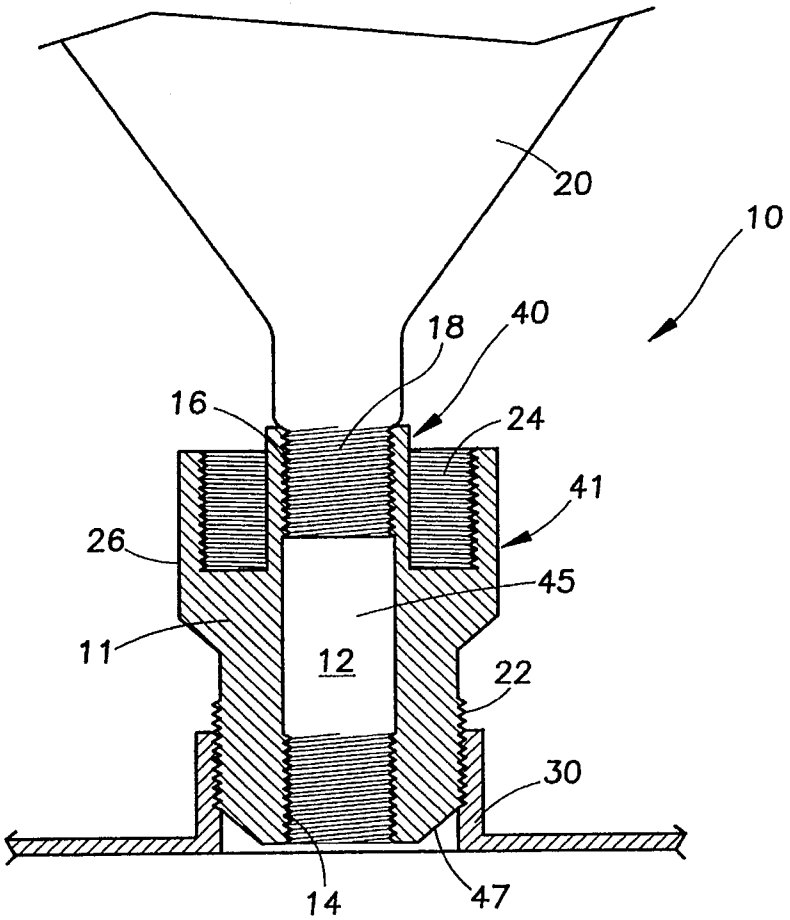
FIG. 4 is a cross sectional view of the invention assembled between a funnel and internally threaded container opening.

FIGS. 4 and 5 disclose the adaptor used first in the case of a container having a internally threaded opening 30 where external threads 22 of the adaptor engage the container and internal bore threads 14 engage the funnel 18. In the second situation the adaptor is reversed and container 32 provides the external threads 34 which engage adaptor internal threads 24 and funnel threads 18 are engaging adaptor threads 16.

It should be understood, of course, that the foregoing disclosure relates to only a preferred embodiment of the invention and that numerous modification or alterations may be made therein without departing from the spirit and scope of the invention as set forth in the appended claims.

What is claimed is:

1. A universal funnel adaptor comprising:

a cylindrically shaped body housing opposite end portions comprising:

a central bore extending through the body between said opposite end portions;

an inner wall concentric with said bore at one end portion of said body of the body;

an outer wall concentric with said bore and radially spaced from said inner wall of the body;

outer wall threads on an inner surface of the outer wall;

an upper end of the inner wall extending above an upper end of the outer wall;

upper internal threads on a inner surface of the central bore adjacent said one end portion of said body;

lower internal threads on a inner surface of the central bore at the opposite end portion of said body;

external threads on an outer surface of the body at the opposite end portion of said body;

a surface for handling and manipulating the body;

a chamfered outer edge on the opposite end portion of the body;

a funnel having engagement threads on a tapened end there of; and wherein the engagement threads are selectively threadingly and releasably engagable with either the upper internal threads or the lower internal threads of the central bore.

2. A universal funnel adaptor according to claim 1 wherein: the body is formed of metal.

3. A universal funnel adaptor according to claim 1 wherein: the body is formed of plastic.

4. A universal funnel adaptor according to claim 1 wherein: the threads are standard pipe threads.

* * * * *